US006932493B2

(12) United States Patent
Giannopoulos et al.

(10) Patent No.: US 6,932,493 B2
(45) Date of Patent: Aug. 23, 2005

(54) FLUORESCENT LIGHT TUBE ADAPTOR

(76) Inventors: Peter Giannopoulos, 61 Aileen Avenue, Caulfield South Victoria 3162 (AU); Brett Andrew McGinnes, 37 Glastonbury Drive, Highton Victoria 3216 (AU)

( * ) Notice: Subject to any disclaimer, the term of this patent is extended or adjusted under 35 U.S.C. 154(b) by 0 days.

(21) Appl. No.: 10/343,096

(22) PCT Filed: Jul. 27, 2001

(86) PCT No.: PCT/AU01/00934

§ 371 (c)(1),
(2), (4) Date: May 9, 2003

(87) PCT Pub. No.: WO02/11250

PCT Pub. Date: Feb. 7, 2002

(65) Prior Publication Data

US 2003/0174498 A1 Sep. 18, 2003

(30) Foreign Application Priority Data

Jul. 28, 2000 (AU) ..... PQ9061

(51) Int. Cl.[7] ..... F21K 7/00

(52) U.S. Cl. ..... 362/260; 362/226; 362/217; 362/457

(58) Field of Search ..... 362/260, 226, 362/217, 457; 439/236, 651, 242

(56) References Cited

U.S. PATENT DOCUMENTS

| | | | | |
|---|---|---|---|---|
| 4,116,525 A | * | 9/1978 | Johnston | 439/564 |
| 4,711,510 A | | 12/1987 | Orlando, Jr. | 439/246 |
| 4,734,050 A | | 3/1988 | Negre et al. | 439/289 |
| 4,803,600 A | | 2/1989 | Pepping | 362/217 |
| 6,225,742 B1 | | 5/2001 | Iida et al. | 315/56 |
| 6,582,253 B1 | * | 6/2003 | Lau | 439/646 |

FOREIGN PATENT DOCUMENTS

| | | | |
|---|---|---|---|
| DE | 4025905 | 2/1992 | H01R/33/08 |
| DE | 4219068 | 12/1993 | H01R/33/08 |
| DE | 20004304 U1 | 7/2000 | F21V/19/00 |
| EP | 0033723 A2 | 8/1981 | H01R/27/00 |
| EP | 0802586 | 10/1997 | H01R/33/00 |
| GB | 291636 | 6/1928 | |
| GB | 597965 | 2/1948 | |
| GB | 909012 | 10/1962 | |
| GB | 2094565 A | 9/1982 | H01R/13/08 |
| GB | 2210211 A | 6/1989 | H01R/13/00 |
| GB | 2214727 A | 9/1989 | H01R/13/08 |
| GB | 2248527 A | 4/1992 | H01R/13/40 |
| WO | WO 99/10955 | 3/1999 | H01R/33/08 |
| WO | WO 99/35892 | 7/1999 | H05B/41/29 |

* cited by examiner

*Primary Examiner*—Sandra O'Shea
*Assistant Examiner*—Sharon Payne
(74) *Attorney, Agent, or Firm*—Schnader Harrison Segal & Lewis LLP

(57) ABSTRACT

An adaptor (2) for fitting a fluorescent tube (80) to a fluorescent tube housing. The adaptor includes a body portion (6) for attachment to an end of the fluorescent tube (80), a pair of contact and arm assemblies and a lid portion (8). Each contact (10, 12) in the pair of assemblies is electrically connectable to a power source. Each arm (14, 16) in the pair of assemblies is adapted for electrical connection to a respective contact (76, 78) of the fluorescent tube (80) so as to provide power from the power source to a fluorescent tube (80).

16 Claims, 6 Drawing Sheets

A
B
2
4
6
8
10
12
10, 12
46
50
52
54
62
64
66
68
70
72

FLUORESCENT LIGHT TUBE ADAPTOR

FIELD OF THE INVENTION

The present invention relates to a fluorescent light tube adaptor and more particularly relates to an adaptor that allows newer and shorter fluorescent tubes to fit into existing fittings that were used to house larger powered and longer fluorescent tubes.

BACKGROUND TO THE INVENTION

Standard fluorescent tubes used throughout the world are generally known as T8 tubes and may be rated at a number of different power values. These fluorescent tubes are gradually being replaced by T5 tubes which also may be rated at a number of different power values but less than a corresponding T8 tube. Such replacement is ongoing in order to reduce energy consumption and thereby minimising greenhouse gas emissions. Consequently, energy costs will also be reduced to business users and residential users. As a result of reducing the power or energy consumption and providing substantially the same illuminance than the existing T8 tubes, the length of the new T5 tubes is shorter than the old T8 tubes. Consequently in order to use the new shorter tubes, corresponding T5 fittings need to be purchased and installed which can be extremely expensive for businesses that have large useable floor space where the lighting requirements to illuminate such floor space involves many fluorescent tubes. Not only would a business be expected to pay a large cost for converting to the new tubes but also for the installations and fittings that go with those new tubes.

The present invention seeks to overcome the abovementioned disadvantages by providing a fluorescent tube adaptor that is adapted to enable the use of the new T5 fluorescent tubes in existing T8 fluorescent tube housings or fittings. In this manner much cost will be saved to businesses and consumers in that they avoid having to replace the existing T8 fluorescent tube light fittings with new T5 fluorescent tube light fittings

SUMMARY OF THE INVENTION

According to a first aspect of the invention there is provided an adaptor for fitting a fluorescent tube to a fluorescent tube housing, said adaptor comprising:

- a body portion for attachment to an end of said fluorescent tube;
- a pair of contact and arm assemblies, each contact in each pair of contact and arm assemblies being electrically connectable to a power source;
- wherein each arm in said pair of assemblies is adapted for electrical connection to a respective contact of said fluorescent tube in order to provide power from the power source to said fluorescent tube.

The adaptor may have a lid portion having an aperture for each contact of the adaptor to extend therethrough. The lid portion may connect to the body portion by suitable connection means such as an interference fit between the lid and body portions.

The body portion may have a recess or cavity for receiving said end of said fluorescent tube. The contacts of said fluorescent tube may extend through a respective aperture in a wall of said body portion to enable electrical contact to a respective arm in said pair of assemblies. The distance between the contacts of said adaptor may be greater than the distance between the contacts of said fluorescent tube.

According to a second aspect of the invention, there is provided an adaptor for attachment to a fluorescent tube, said adaptor comprising:

- a body portion attachable to one end of said fluorescent tube;
- an assembly including a pair of contacts and corresponding arms, each contact in said pair being electrically connectable to a power source;
- each corresponding arm being adapted for electrical connection to a respective contact of said fluorescent tube such that power is provided from said power source to said fluorescent tube;
- wherein said adaptor and said fluorescent tube together enable fitting to a fluorescent tube housing.

BRIEF DESCRIPTION OF THE DRAWINGS

A preferred embodiment of the invention will be hereinafter described, by way of example only, with reference to the drawings, in which.

DETAILS DESCRIPTION OF PREFERRED EMBODIMENTS

Figure 2:
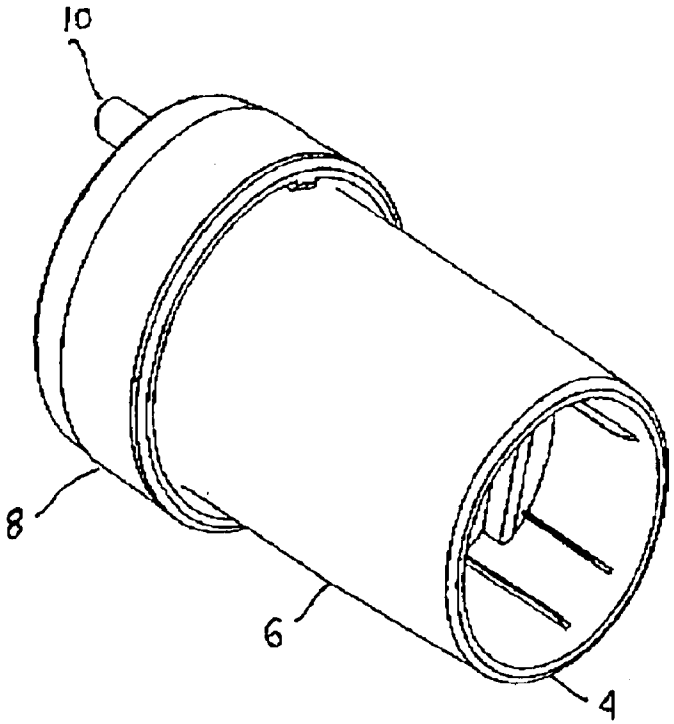
FIG. 2 is a perspective view from the rear and above of the adaptor of FIG. 1.
Figure 1:
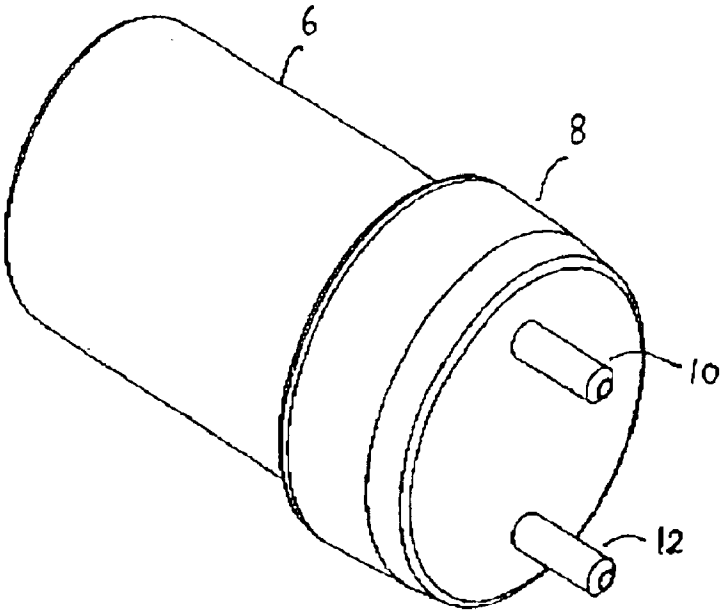
FIG. 1 is a perspective view from the front and above of an adaptor according to the present invention.

With reference to FIGS. 1 to 4 there is shown an adaptor 2 having a body portion 6 of which one end 4 may be placed over a corresponding end of a fluorescent tube. The adaptor 2 also includes a lid portion 8 adapted to fit over the other end of the body portion 6 and also has a pair of contacts 10, 12 for connection to respective fittings of a power source.

Figure 6:
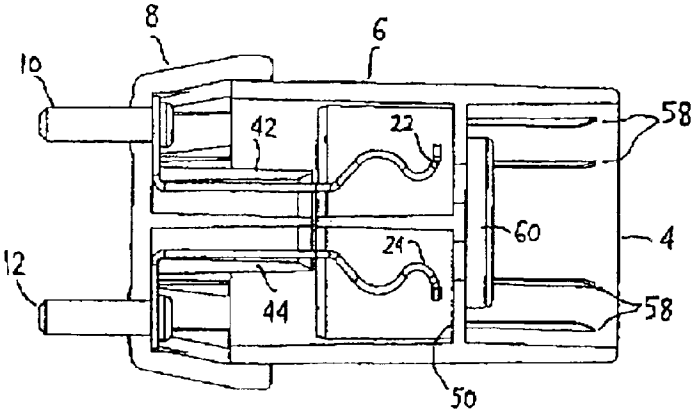
FIG. 6 is a part sectional side view of the components of the adaptor in an assembled state.
Figure 5:
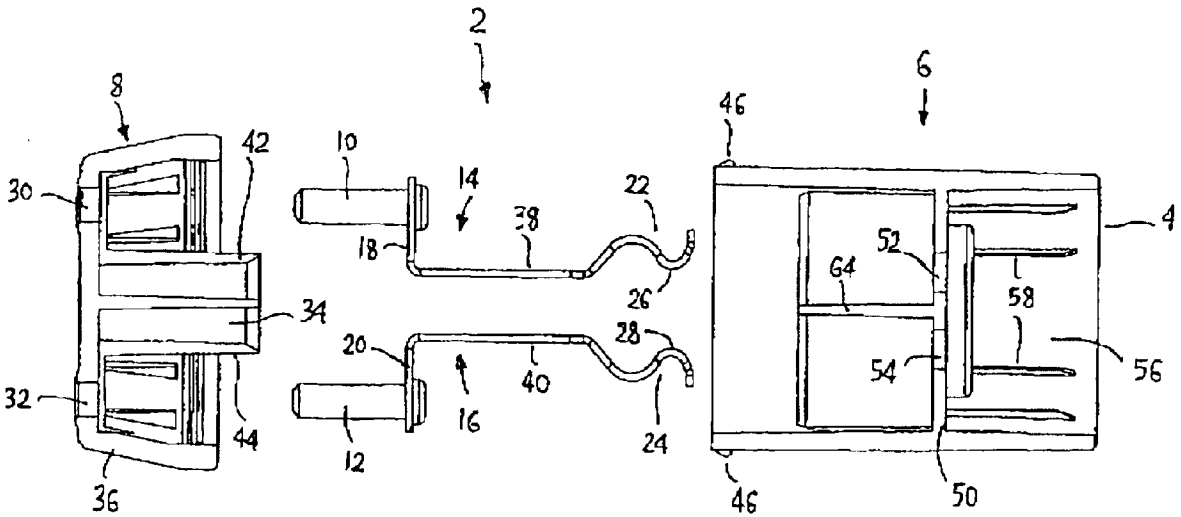
FIG. 5 is a part sectional side view of components that make up the adaptor, including a lid portion, a body portion and a pair of contact and arm assemblies.

With reference to FIGS. 5 and 6 the various components of the adaptor 2 are shown in more detail.

Each contact 10 and 12 is secured to respective depending arms 14 and 16 to form a pair of contact and arm assemblies. More particularly contact 10 is attached to flange 18 of depending arm 14 and contact 12 is attached to flange 20 of depending arm 16. Each of the arms 14 and 16 are made resilient by having curved ends 22 and 24 which are adapted to receive and make contact with contacts of the fluorescent tube. More particularly the contacts of the fluorescent tube are each adapted to prise apart the ends 22 and 24 and respectively make contact at about portions 26 and 28 of the ends 22 and 24.

The lid portion 8 has aperture 30 through which contact 10 is received and aperture 32 through which contact 12 is received as is more clearly shown in the installed version of the adaptor in FIG. 6. Within the interior of the lid portion 8 there is a securing means 34 which assists in keeping the contacts 10 and 12 and their depending arms 14 and 16 in position. In order to insert the contacts 10 and 12 and their depending arms 14 and 16 the securing means 34 is removed from the shell 36 of the lid portion 8 and then the respective contacts 10 and 12 are forced through the apertures 30 and 32. The securing means 34 is then positioned over the ends 22 and 24 and pushed tip against the flanges 18 and 20 as is shown in FIG. 6. In this manner the substantially straight portions 38 and 40 of the arms 14 and 16 abut against an interior surface of portions 42 and 44 of the securing means 34. The lid portion 8 is then secured to the body portion 6 by means of an interference fit wherein interior parts of the lid portion 8 are secured over tab or ridge 46 of the body portion 6.

When the adaptor is an installed unit as in FIG. 6 the ends 22 and 24 of arms 14 and 16 respectively end a short distance from an interior wall 50 within the body portion 6. Within the wall there are defined apertures 52 and 54 to allow respective contacts of the fluorescent tube to fit through and subsequently make contact with portion 26 and 28 of the ends 22 and 24. Thus the fluorescent tube is in electrical contact completely with the power source, typically an electronic ballast which is connect to the contacts 10 and 12. The power source is designed to deliver the required power to whatever rating fluorescent tube is used. The fluorescent tube and its contacts are shown inserted into the recess portion 56 of the body portion 6 and wherein the contacts are in electrical connection with the arms 14 and 16 (see FIG. 18). The recess portion 56 is substantially cylindrical and located on the interior edge of the body portion are ribs 58 which assist in gripping the end of the fluorescent tube that is inserted into the recess 56. The end face of the fluorescent tube abuts against a wall 50 within a further recess portion 60.

Figures 4, 7, 8, 9, 10, 11, 12:
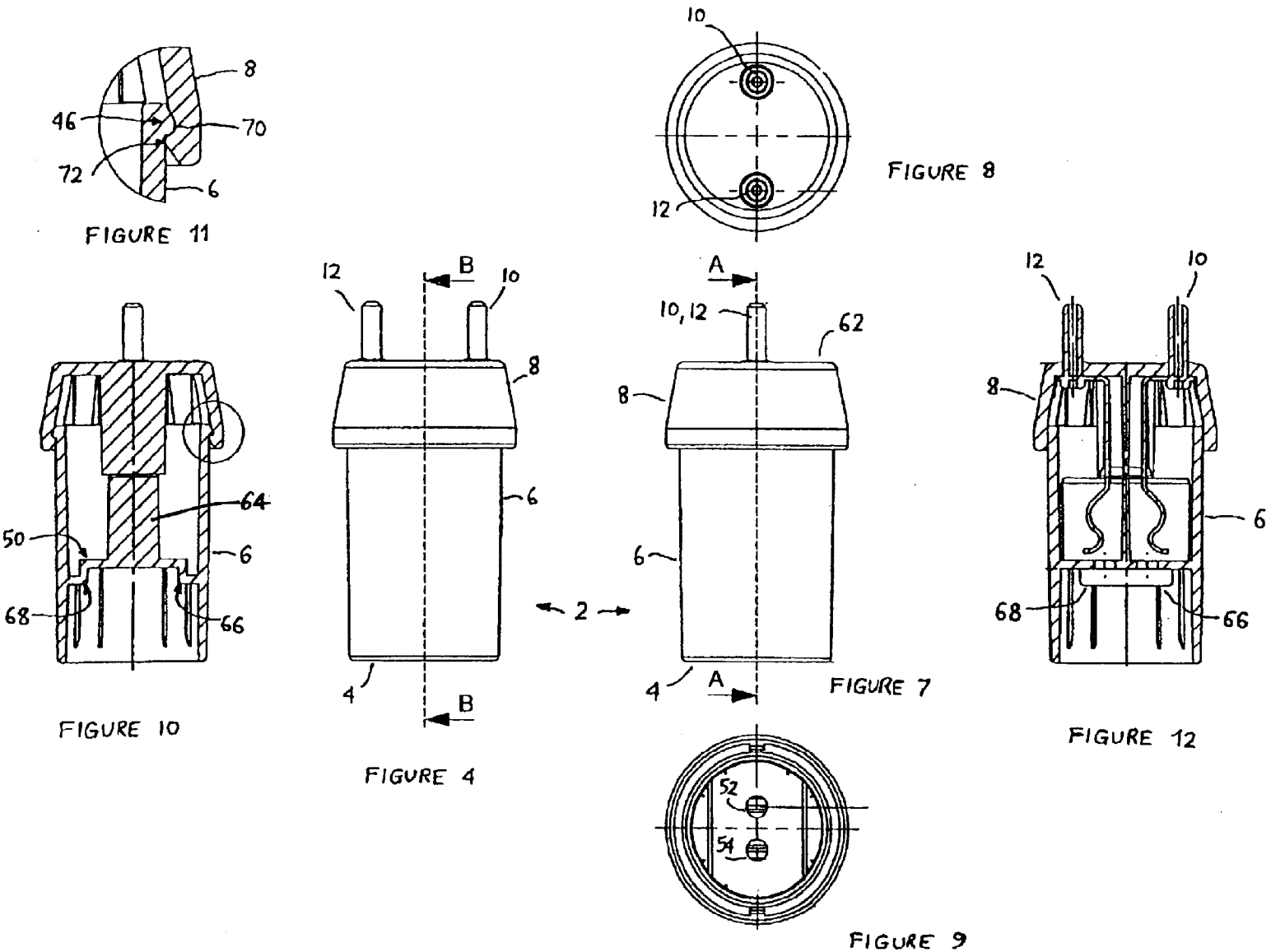
FIG. 4 is a side view of the adaptor according to the present invention.
FIG. 7 is a side view of the adaptor of FIG. 4 but rotated through 90°.
FIG. 8 is an end view corresponding to one end of the adaptor of FIG. 7.
FIG. 9 is an end view showing the other end of the adaptor of FIG. 7.
FIG. 10 is a sectional side view taken along the line B—B of FIG. 4.
FIG. 11 is an exploded sectional view showing the interference fit between a lid portion and body portion of the adaptor of FIG. 10.
FIG. 12 is a sectional view taken along the line A—A of FIG. 7.

With reference to FIGS. 7, 8 and 9 there is shown an alternative view of the adaptor 2. More particularly in FIG. 7 it is rotated through 90° with respect to FIG. 4 and in FIG. 8 there is shown an end view showing end 62 of lid portion 8 and in FIG. 9 there is shown an end view of the end 4 of the base portion 6. In this particular embodiment the overall length of the adaptor, and more particularly the lid portion 8 and base portion 6 is 36.5 mm and with the contacts protruding through the lid portion 8 the overall length is 43.5 mm. However it is to be noted that the adaptor 2 is not restricted to this particular set of measurements. In FIG. 8 the separation or distance between the contacts 10 and 12 is about 13 mm, centre to centre and from FIG. 9 the separational distance between the contacts of the fluorescent tube is about 5.2 mm, centre to centre. Thus the distance between the contacts of the new fluorescent tube is much smaller than the separation of the contacts of the older existing tubes which would originally have had their spacing of contacts substantially the same as that of the present contacts 10 and 12. As can be seen from FIG. 7 the additional length provided by the adaptor 2 makes up for the shortfall in distance between the existing housing for the older fluorescent tubes and the length of the new fluorescent tubes. The dimensions of the adaptor, including the lid and body portions and contact and arm assemblies can be variable depending on the requirements for fitting the fluorescent tube to existing fittings and depending on the dimensions and power rating of the tube.

With reference to FIG. 10 there is shown a cross sectional view along the lines BB of FIG. 4 and showing a separating partition 64 within the body portion 6 that separates the two arms 14 and 16. The wall 50 is shown as being recessed at corner 66 and 68 to accommodate the end of the fluorescent tube. This is shown in an alternative view rotated through 90° in FIG. 12. In FIG. 11 there is shown an exploded view of the edge fitting of the lid portion 8 to the body portion 6 whereby an interference fit is formed by a convex ridge or protuberance 46 which extends around the circumference of the end of the body portion and by a corresponding concave section 70 in lid portion 8 that has a protuberance 72 to fit against the ridge 46. In this manner a snap fit lock is achieved between the lid portion 8 and body portion 6.

Figure 3:
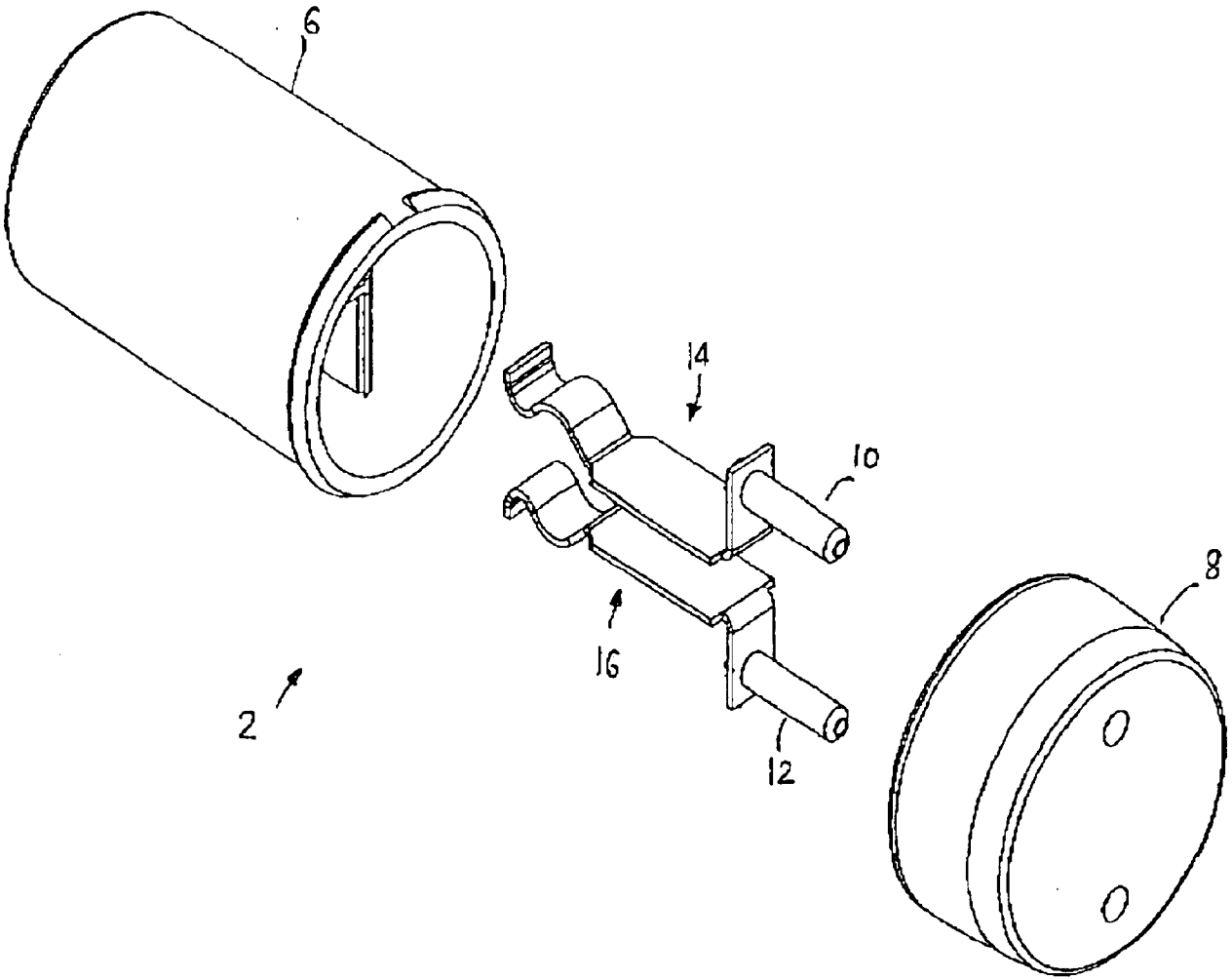
FIG. 3 is a perspective view showing the adaptor unassembled.
Figure 13:
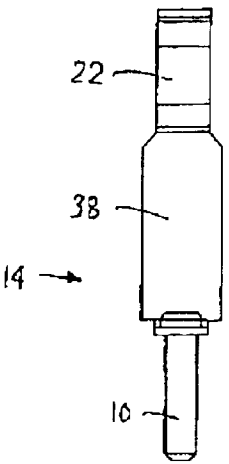
FIG. 13 is a top view of an arm and contact assembly of the adaptor.
Figure 14:
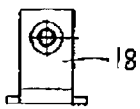
FIG. 14 is an end view showing the contact portion of the contact and arm assembly of FIG. 13.
Figure 15:
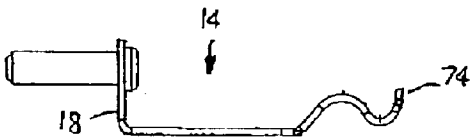
FIG. 15 is a side view of one contact and arm assembly of the adaptor.
Figure 16:
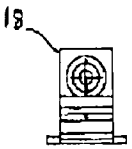
FIG. 16 is an end view of the other end of the contact and arm assembly of FIG. 15.
Figure 17:
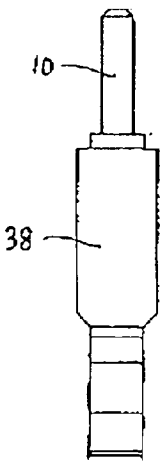
FIG. 17 is a bottom view of the contact and arm assembly of the adaptor.

In FIGS. 13 through to 17 there are shown various views of one of the contact and arm assemblies. In this example contact 10 and depending arm 14 is shown. It is noted that the mid section 38 of the arm 14 is wider than the other parts of the arm 14 and notably wider than the end 22. The width of the mid section 38 may be up to 5 mm and the width of the end 22 being 4 mm. The length of the mid section 38 may be 13.3 mm and the overall length of the depending arm from the flange 18 to the very end portion 74 of arm 14 may be about 21.5 mm and including the contact 10 the overall length will be 30 mm. It is to be understood that this is only one particular embodiment and the measurement is not limited to these dimensions. Ideally the depending arm 14 and contact 10 may be made from copper or any suitable conductor. A perspective view of the arm 14 and contact 10 is shown in FIG. 3. Both the lid portion 8 and body portion 6 may be made from any suitable plastics material.

Figure 18:
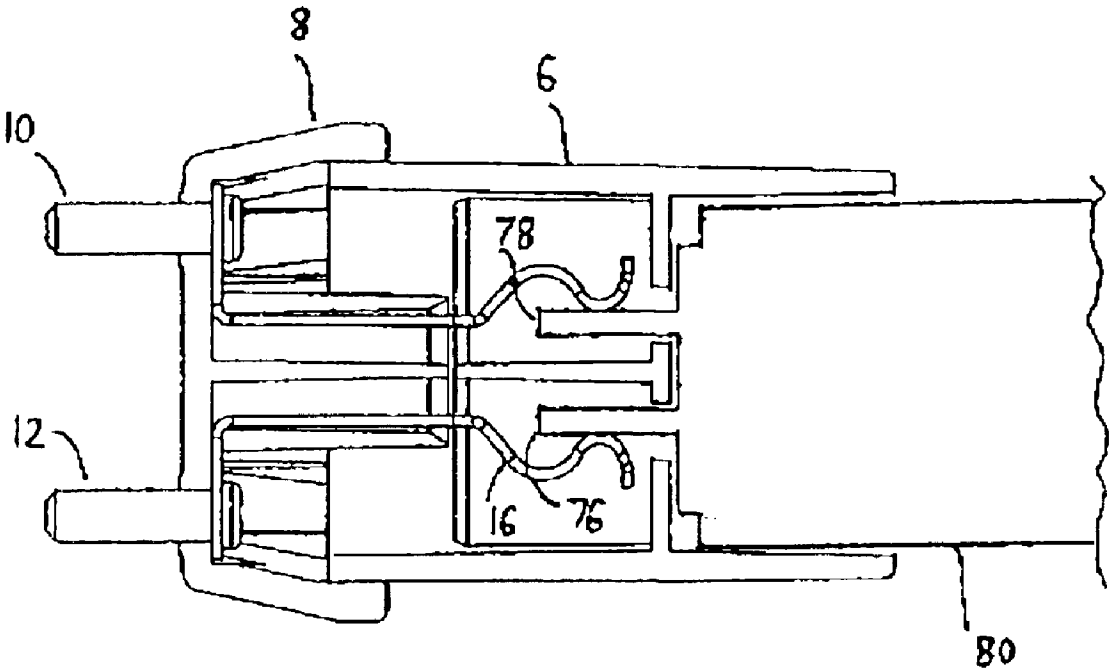
FIG. 18 is a part sectional view showing the fluorescent tube fitting within a recess of the adaptor and making contact with depending arms of the contact and arm assembly of the adaptor.

In FIG. 18 there is shown the fluorescent light tube 80 fitted within the recess 56 of the body portion 6 and wherein contacts 76 and 78 of the tube are in direct electrical connection with the arms 16 and 14 respectively. On insertion of the contacts 76 and 78 through apertures 54 and 52 the resilience of the arms 14 and 16 allow deflection of each arm on contact with the contacts 76 and 78. The end of the tube 80 is held within the recess by the ribs or protuberances 58.

The present invention as described advantageously provides an adaptor fitting to new fluorescent light tubes, the tubes being shorter than previously used and even currently used fluorescent tubes, while still being able to use existing light fittings or housings. Thus a consumer is presented with a large cost saving in not having to replace the existing light fittings with new light fittings adapted to receive the new fluorescent light tubes. It is easy to install the new fluorescent tubes with the adaptor fitted.

What is claimed is:

1. An adaptor for fitting a fluorescent tube to a fluorescent tube housing, said adaptor comprising:

a body portion for attachment to an end of said fluorescent tube;

a pair of contact and arm assemblies, each contact in each pair of contact and arm assemblies being electrically connectable to a power source from the fluorescent tube housing and protecting longitudinally beyond the body portion for engagement in the fluorescent tube housing;

wherein each arm in said pair of assemblies is adapted for electrical and mechanical connection to a respective contact of said fluorescent tube in order to provide power from the power source to said fluorescent tube.

2. An adaptor according to claim 1 further comprising a lid portion adapted to engage said body portion, said lid portion having each said contact of each contact and arm assembly extending therethrough.

3. An adaptor according to claim 1 wherein said body portion has a recess or cavity for receiving said end of said fluorescent tube.

4. An adaptor according claim 3 wherein said body portion has a wall extending substantially across the interior of said body portion and defining a boundary of said recess or cavity.

5. An adaptor according to claim 4 wherein said wall has a pair of apertures, each aperture providing a passage for each contact of said fluorescent tube such that each contact of said fluorescent tube is connectable to a respective arm in said pair of contact and arm assemblies.

6. An adaptor according to claim 5 wherein each arm in said pair of contact and arm assemblies is defined at one end by a flange to which each contact in said pair of assemblies is attachable and at another end by a curved section.

7. An adaptor according to claim 6 wherein each contact and arm assembly is resilient to allow each contact of said fluorescent tube to establish suitable connection to a respective arm in said pair of assemblies, such that one arm in said pair of assemblies splays outwardly with respect to the other arm in said pair of assemblies when said contacts of said fluorescent tube initially engage with said arms in said pair of assemblies.

8. An adaptor according to claim 3 wherein said body portion has ribs formed within said recess or cavity for retaining said end of said fluorescent tube within said recess or cavity.

9. A fluorescent tube having an adaptor according to claim 1.

10. A fluorescent tube and fluorescent tube fitting having an adaptor according to claim 1.

11. An adaptor for attachment to a fluorescent tube, said adaptor comprising: a body portion attachable to one end of said fluorescent tube; an assembly including a pair of contacts and corresponding arms, each contact in said pair protecting beyond said body portion and being electrically connectable to a power source; each corresponding arm being adapted for electrical connection to a respective contact of said fluorescent tube such that power is provided from said power source to said fluorescent tube; wherein said adaptor and said fluorescent tube together enable fitting to a fluorescent tube housing.

12. An adaptor according to claim 11 further comprising a lid portion adapted to engage said body portion and wherein each contact in said pair of contacts extends through a respective aperture in said lid portion.

13. An adaptor according to claim 11 wherein the distance between each contact in said pair of contacts is greater than the distance between the respective contacts of said fluorescent tube.

14. An adaptor for fitting a fluorescent tube to a fluorescent tube housing, said adaptor comprising:

a body portion for attachment to an end of said fluorescent tube;

a pair of contact and arm assemblies, each contact in each pair of contact and arm assemblies being electrically connectable to a power source;

wherein each arm in said pair of assemblies is adapted for electrical connection to a respective contact of said fluorescent tube in order to provide power from the power source to said fluorescent tube;

said body portion has a recess or cavity for receiving said end of said fluorescent tube;

wherein said lid portion has at least one internal protuberance that forms an interference fit with a corresponding protuberance adjacent one end of said body portion in order to form a fixed connection between said lid portion and said body portion.

15. An adaptor for fitting a fluorescent tube to a fluorescent tube housing, said adaptor comprising:

a body portion for attachment to an end of said fluorescent tube;

a pair of contact and arm assemblies, each contact in each pair of contact and arm assemblies being electrically connectable to a power source; wherein each arm in said pair of assemblies is adapted for electrical connection to a respective contact of said fluorescent tube in order to provide power from the power source to said fluorescent tube;

wherein said body portion has a wall extending substantially across the interior of said body portion and defining a boundary of said recess or cavity;

wherein said wall has a pair of apertures, each aperture providing a passage for each contact of said fluorescent tube such that each contact of said fluorescent tube is connectable to a respective arm in said pair of contact and arm assemblies;

wherein each arm in said pair of contact and arm assemblies is defined at one end by a flange to which each contact in said pair of assemblies is attachable and at another end by a curved section;

wherein each contact and arm assembly is resilient to allow each contact of said fluorescent tube to establish suitable connection to a respective arm in said pair of assemblies, such that one arm in said pair of assemblies splays outwardly with respect to the other arm in said pair of assemblies when said contacts of said fluorescent tube initially engage with said arms in said pair of assemblies;

wherein said lid portion has a detachable securing means to securely keep each contact and arm assembly in position within said adaptor.

16. An adaptor for fitting a fluorescent tube to a fluorescent tube housing, said adaptor comprising:

a body portion for attachment to an end of said fluorescent tube;

a pair of contact and arm assemblies, each contact in each pair of contact and arm assemblies being electrically connectable to a power source;

wherein each arm in said pair of assemblies is adapted for electrical connection to a respective contact of said fluorescent tube in order to provide power from the power source to said fluorescent tube;

further comprising a lid portion adapted to engage said body portion, said lid portion having each said contact of each contact and arm assembly extending therethrough;

wherein said lid portion has at least one internal protuberance that forms an interference fit with a corresponding protuberance adjacent one end of said body portion in order to form a fixed connection between said lid portion and said body portion.

* * * * *